US007896082B2

(12) United States Patent
Lake et al.

(10) Patent No.: US 7,896,082 B2
(45) Date of Patent: Mar. 1, 2011

(54) METHODS AND APPARATUS FOR NEGATING MINERAL SCALE BUILDUP IN FLAPPER VALVES

(75) Inventors: Gary B. Lake, Houston, TX (US); Ronnie D. Russell, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 79 days.

(21) Appl. No.: 12/403,162

(22) Filed: Mar. 12, 2009

(65) Prior Publication Data

US 2010/0230109 A1 Sep. 16, 2010

(51) Int. Cl.
*E21B 34/10* (2006.01)

(52) U.S. Cl. ..... 166/375; 166/386; 166/332.8

(58) Field of Classification Search ..... 166/375, 166/386, 330, 331, 332.8
See application file for complete search history.

(56) References Cited

U.S. PATENT DOCUMENTS

| | | | | |
|---|---|---|---|---|
| 6,273,187 | B1 * | 8/2001 | Voisin et al. | 166/63 |
| 7,347,269 | B2 * | 3/2008 | Layton | 166/332.1 |
| 7,543,651 | B2 * | 6/2009 | Smith et al. | 166/386 |
| 2007/0251696 | A1 * | 11/2007 | Parks | 166/373 |
| 2010/0108320 | A1 * | 5/2010 | Larnach | 166/310 |

* cited by examiner

*Primary Examiner* — William P Neuder
(74) *Attorney, Agent, or Firm* — Shawn Hunter

(57) ABSTRACT

Methods and devices for negating scale buildups on interior surfaces of a sliding sleeve valve housing above the flow tube. In some aspects, a wiper member provides additional clearance between the flow tube and housing to compensate for scale buildup. In other aspects, the interior surface of the valve housing is provided with a sleeve that is disposed between the interior surface of the valve housing and the general flowbore passing through the valve housing to protect the interior surface against scale buildup.

16 Claims, 11 Drawing Sheets

METHODS AND APPARATUS FOR NEGATING MINERAL SCALE BUILDUP IN FLAPPER VALVES

BACKGROUND OF THE INVENTION

1. Field of the Invention

The invention relates generally to devices and methods for controlling and removing the buildup of mineral scales and the like upon subsurface safety valves.

2. Description of the Related Art

Surface-controlled, subsurface safety valves ("SCSSV's") are typically used in production string arrangements to quickly close off the production flowbore in the event of an emergency, such as a blowout. A usual form for an SCSSV is a flapper-type valve that includes a flapper member that is pivotally movable between open and closed positions within the flowbore. The flapper member is actuated between the open and closed positions by a flow tube that is axially movable within the flowbore.

After being placed into a wellbore, mineral scale typically forms and builds up on all portions of the production tubing string that are exposed to wellbore fluids. Portions of the flowbore that have a pressure drop are particularly vulnerable to scale buildup. Scale and other buildup forming on and around the flow tube of the SCSSV can make it difficult to move the flow tube axially and thereby prevent proper operation of the SCSSV. Of particular concern is the interior surface of the flowbore within the valve housing that is located above the flow tube, as scale buildup in that location can prevent the flow tube from moving axially and prevent the valve from closing.

Wireline brushes can be used to try to clean the scale buildup from the flow tube and surrounding valve housing. However, this is costly as it necessitates stopping production operations to run the brush in and then conduct the cleaning.

SUMMARY OF THE INVENTION

In preferred embodiments, the invention provides exemplary subsurface safety valve designs that are operable to clean and remove or to prevent buildups of scale that might prevent operation of the valve. In other aspects, the invention provides methods and devices for cleaning and removing or preventing scale buildups on interior surfaces of a sliding sleeve valve housing above the flow tube. In some exemplary embodiments, the flow tube of the valve includes a wiper member that extends radially outwardly from the flow tube and into contact with the interior surface of the valve housing. The wiper member provides a physical spacer that increases the spacing between the flow tube and housing, which counteracts the effect of scale buildup and permits operation of the valve even after some buildup has occurred. The wiper member is also operable to physically wipe away or otherwise remove the scale buildup. In particular preferred embodiments, the wiper member contains or is formed of a scale dissolving material that helps to dissolve and remove the scale buildup from the interior surface. A wiper member that releases small amounts of the scale dissolving substance on the interior surface above the flow tube helps prevent scale deposition in this area of the valve.

In other embodiments, the interior surface of the valve housing is provided with a sleeve that is disposed between the interior surface of the valve housing and the general flowbore passing through the valve housing to protect the interior surface against scale buildup. In addition, the sleeve serves to provide a substantially smooth and continuous interior surface of substantially uniform diameter and, therefore, minimizing a pressure drop across the valve that would tend to permit scale buildup. In varied embodiments, the sleeve is formed of an elastomeric material or a metallic material that is axially compressible. In further embodiments, the sleeve is substantially rigid and retained in a recess formed in either the valve housing or the flow tube. As the valve is actuated to a closed position, the sleeve retracts into the recess. In some embodiments, the sleeve is biased axially outwardly from the recess. In other embodiments, the sleeve is securely affixed to the flow tube.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
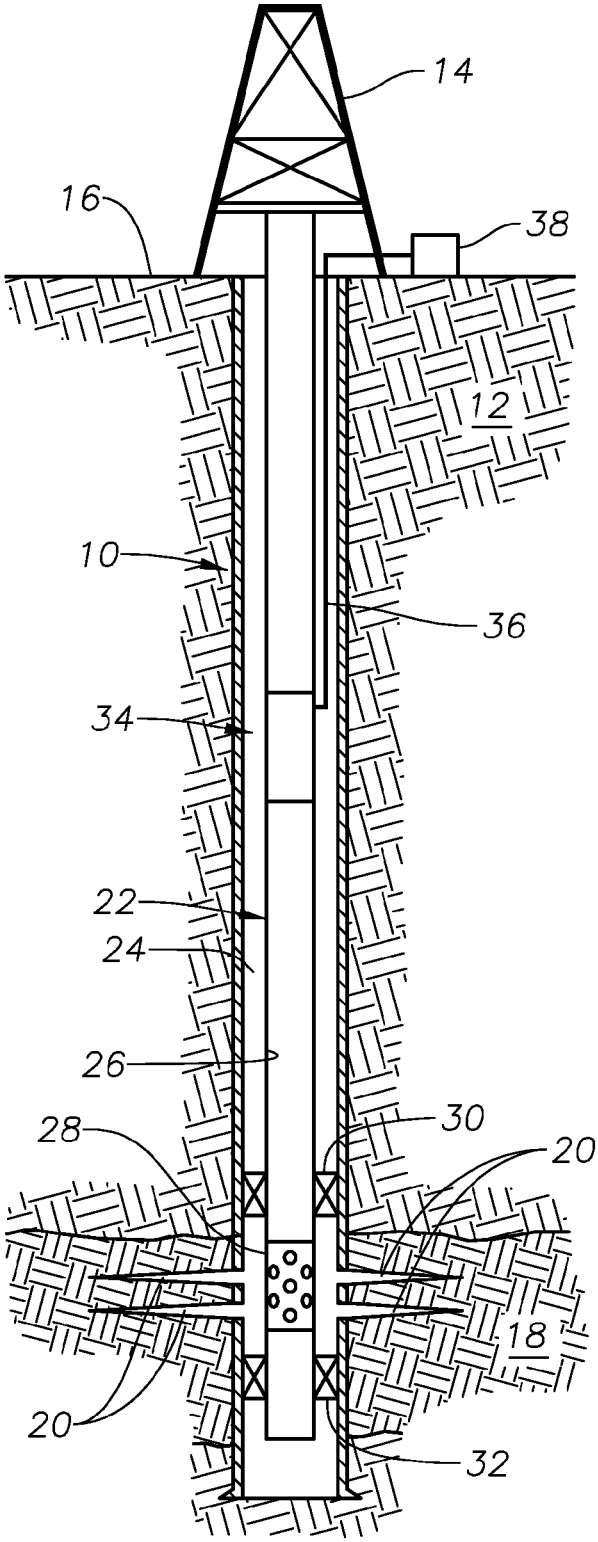
FIG. 1 is a side, cross-sectional view of an exemplary hydrocarbon production tubing string within a wellbore and containing a SCSSV in accordance with the present invention.

FIG. 1 illustrates an exemplary wellbore 10 which has been drilled through the earth 12 from a drilling rig 14 located at the surface 16. The wellbore 10 is drilled down to a hydrocarbon-bearing formation 18. As is known in the art, perforations 20 extend outwardly into the formation 18.

An exemplary production tubing string 22 extends downwardly within the wellbore 10 from the surface 16. An annulus 24 is defined between the production tubing string 22 and the wall of the surrounding wellbore 10. The production tubing string 22 is typically made up of sections of interconnected production tubing, as is know in the art. In alternative embodiments, the production tubing string 22 may be formed of coiled tubing. The production tubing string 22 defines a production flowbore 26 along its length for the transport of production fluids from the formation 18 to the surface 16. A ported production nipple 28 is incorporated into the production tubing string 22 and is used to flow production fluids from the surrounding annulus 24 to the flowbore 26. Packers 30, 32, of a type known in the art, secure the production tubing string 22 within the wellbore 10.

The production tubing string 22 also includes a surface-controlled subsurface safety valve (SCSSV) 34. The SCSSV 34 is used to quickly and easily close off fluid flow through the flowbore 26 in the event of an emergency. The general construction and operation of flapper valves is well known in the art. Flapper valve assemblies are described, for example, in U.S. Pat. No. 7,270,191 by Drummond et al. entitled "Flapper Opening Mechanism" and U.S. Pat. No. 7,204,313 by Williams et al. entitled "Equalizing Flapper for High Slam Rate Applications." U.S. Pat. Nos. 7,270,191 and 7,204,313 are owned by the assignee of the present application and are hereby incorporated by reference. A hydraulic control line 36 extends from the valve 34 to a control pump 38 at the surface 16.

Figure 2:
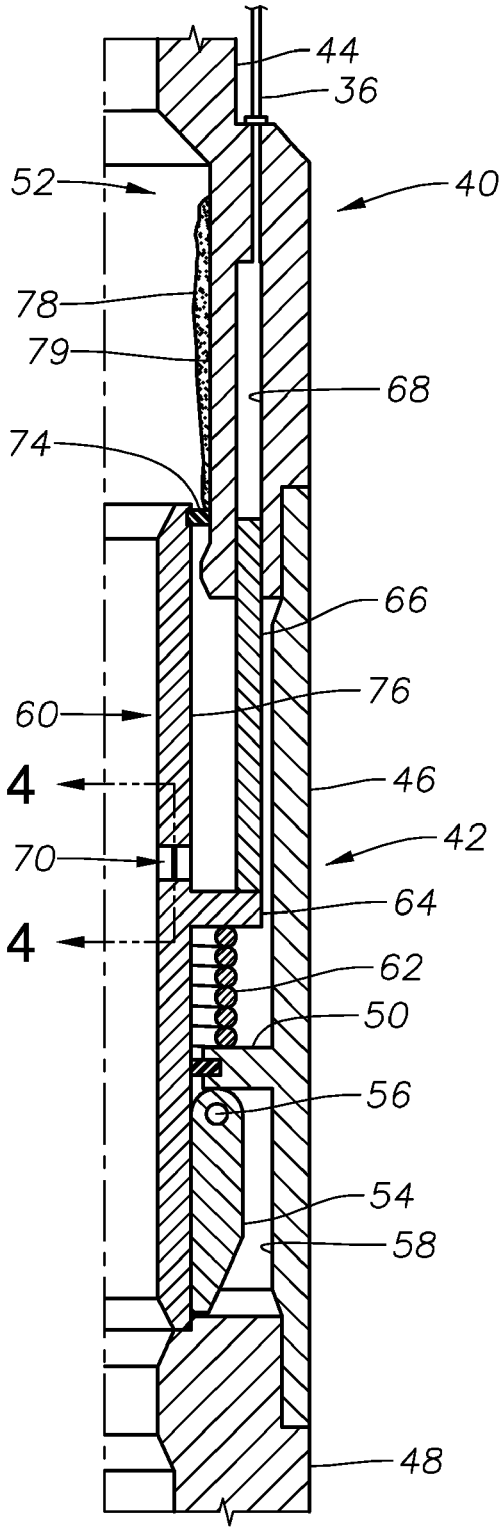
FIG. 2 is a side, one-quarter cross-sectional view of a currently preferred embodiment for a SCSSV constructed in accordance with the present invention.
Figure 3:
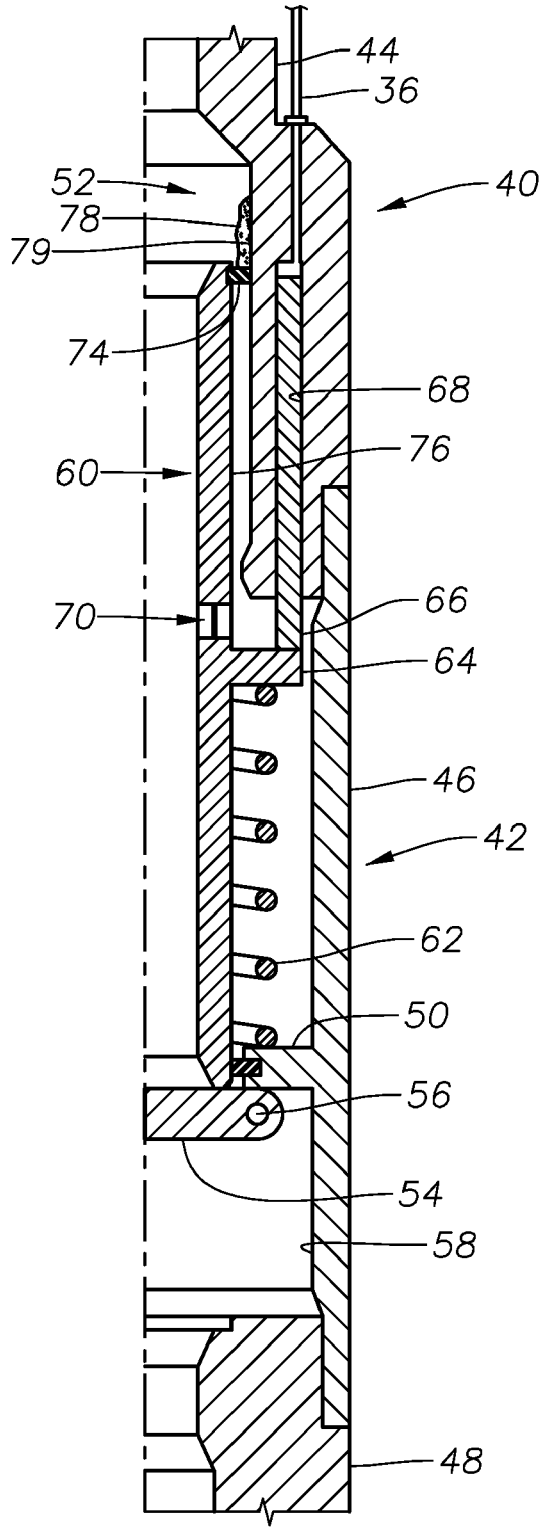
FIG. 3 is a side, one quarter cross-sectional view of the SCSSV shown in FIG. 2, now with the valve closed.

FIGS. 2 and 3 depict a first exemplary SCSSV 40 constructed in accordance with the present invention and which may be used as the SCSSV 34 in the arrangement depicted in FIG. 1. The valve 40 generally includes a housing 42 that is formed of an upper housing sub 44, a central housing sub 46 and a lower housing sub 48. A radially inwardly-projecting flange 50 is carried by the central housing sub 46. The housing 42 defines a central flowbore 52 within which becomes a portion of the flowbore 26 when the housing 42 is integrated into the production tubing string 22.

A pivotable flapper member 54 is retained upon a pivot pin 56 within a flapper member cavity 58 that is defined within the housing 42. As is known, the flapper member 54 is movable about the pivot pin 56 between an open position, depicted in FIG. 2, wherein fluid can pass through the central flowbore 52, and a closed position, illustrated in FIG. 3, wherein flow through the flowbore 52 is blocked by the flapper member 54. The flapper member 54 is biased toward the closed position, typically by a torsional spring (not shown), in a manner known in the art.

A flow tube 60 is disposed within the housing 42 and is axially movable with respect to the housing 42 between an upper position (FIG. 3) and a lower position (FIG. 2). The flow tube 60 is biased toward the upper position by compressive spring 62. In an exemplary embodiment, the spring 62 is compressed between the flange 50 and a radially-projecting arm 64 on the flow tube 60. An axially-extending piston member 66 is affixed to the arm 64 and is movably disposed within a piston chamber 68. The piston chamber 68 is operably interconnected with the hydraulic control line 36 such that surface changes by the pump 38 will create fluid pressure fluctuations within the chamber 68 and thereby move the piston member 66 within the piston chamber 68.

Figure 4:
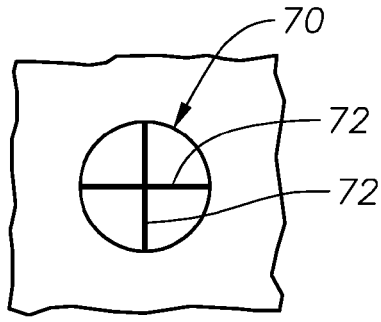
FIG. 4 is a detail cross-section taken along lines 4-4 in FIG. 2.

The flow tube 60 also preferably includes a screening bleed port 70 which is best depicted in FIG. 4. The bleed port 70 preferably features a pair of cross-slots 72 which allow fluid pressure to be equalized between the radial interior and radial exterior of the flow tube 60. The bleed port 70 is desirable in situations wherein a wiper member is incorporated into the flow tube 60, as it is desired to equalize pressure around the flow tube 60 and prevent the creation of a pressure differential. The bleed port 70 preferably contains zero-gap until slight fluid pressure flexes the port 70 open to begin allowing fluid flow flow therethrough to begin allowing flow until pressure across the bleed port 70 equalizes.

An annular wiper member 74 is secured to the outer radial surface 76 of the flow tube 60. An exemplary buildup of mineral scale is depicted at 78. In a preferred embodiment, the wiper member 74 is formed of a relatively soft material that is abraded as the wiper member 74 contacts and moves against the interior surface 79 of the flowbore 52 and scale buildup 78. The wiper member 74 is preferably formed largely of a soft elastomeric or thermoplastic material. In further embodiments, the wiper member 74 incorporates scale-dissolving material, such as hydrochloric acid, within the wiper material using known processes, such as chemical encapsulation or micro-encapsulation according techniques known in the art. The scale dissolver will act to dissolve or remove scale 78 as the wiper member 74 is moved upon the scale 78. A number of alternative commercially available scale dissolvers are known in the art which are suitable for this application.

In operation, the SCSSV 40 is run into the wellbore 10 in the position depicted in FIG. 2, wherein the flapper member 54 is in the open position, and production through the production tubing string 22 can occur as is typical. In this position, the piston chamber 68 is pressurized by the surface pump 38 so that the piston 66 and flow tube 60 are retained in the axially downward position shown in FIG. 2 and the spring bias of the compression spring 62 is overcome to do so. In the event of an emergency, an operator at the surface 16 can close the SCSSV, or valve, 40 by actuating the pump 38 to evacuate the piston chamber 68. The spring bias of the compression spring 62 will urge the flow tube 60 axially upwardly to the position depicted in FIG. 3. The flapper member 54 will then rotate to the closed position shown in FIG. 3, thereby blocking fluid flow upwardly through the flowbore 52 of the valve 40.

As the flow tube 60 is moved axially upwardly within the housing 42, the wiper member 74 is moved axially along the interior surface 79 of the flowbore 52. As this axial movement occurs, the wiper member 74 abrades and releases the incorporated scale dissolver to act upon the scale buildup 78, thereby completely or partially dissolving and removing the scale buildup 78. Every time the valve moves from the open to the closed position and back again, the wiper member 74 will release an amount of scale dissolver upon the interior surface 79. The scale dissolver will leave a slick surface 79 that helps to prevent scale particles from sticking and accumulating upon the surface 79.

Figure 5:
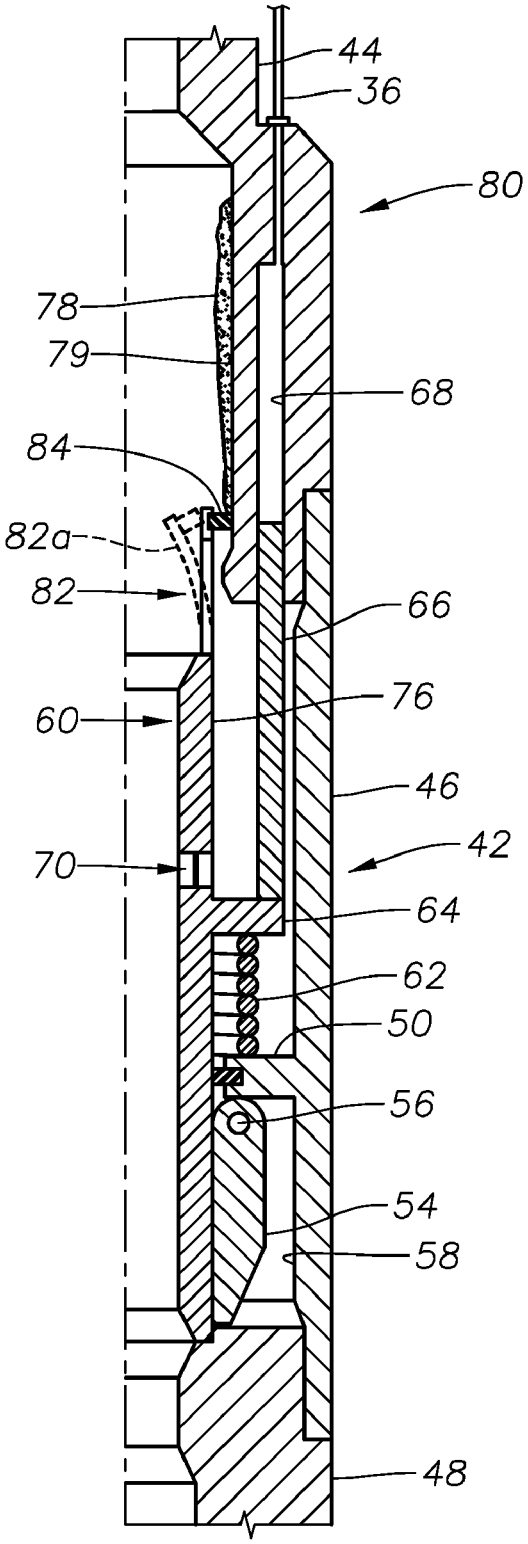
FIG. 5 is a side, one-quarter cross-sectional view of a second preferred embodiment for a SCSSV constructed in accordance with the present invention.

FIG. 5 illustrates an alternative exemplary SCSSV 80 in accordance with the present invention. The SCSSV 80 may also be used as the SCSSV 34 in the arrangement depicted in FIG. 1. In the SCSSV 80, the flow tube 60 includes a flexible skirt 82 which extends axially upwardly from the body of the flow tube 60. In currently preferred embodiments, the flexible skirt 82 is formed of a flexible polymer of a type known in the art. In an alternative embodiment, the skirt 82 is formed of overlapping metal sheets. The skirt 82 is flexible in that it can deflect radially inwardly, as illustrated by the dashed lines 82*a*. However, it is preferred that the skirt 82 be formed with shape memory so that it will provide a radial outward bias against the interior surface 79. This bias will help prevent sand and debris from becoming disposed between the flow tube 60 and the housing 42. The distal end of the skirt 82 includes a radially outwardly extending wiper or scraper member 84. The scraper member 84 is shaped and sized to contact the interior surface 79 of the flowbore 52. During movement of the flow tube 60 with respect to the surrounding housing 42, the scraper member 84 is operable to physically scrape some of the scale buildup 78 from the interior surface 79. The scraper member 84 is shaped so that, for scale buildup 78 that is 78 that is not removed, the scraper member 84 will flex over the scale buildup 78 like a sled rides over snow. In addition, the scraper member 84 serves as a spacer member disposed between the flow tube 60 and the surrounding housing 42. The increased clearance afforded by this spacing helps to mitigate the effects of scale accumulation upon the interior surface 79 and will permit the flow tube 60 to move within the housing 42 despite some buildup.

Figure 6:
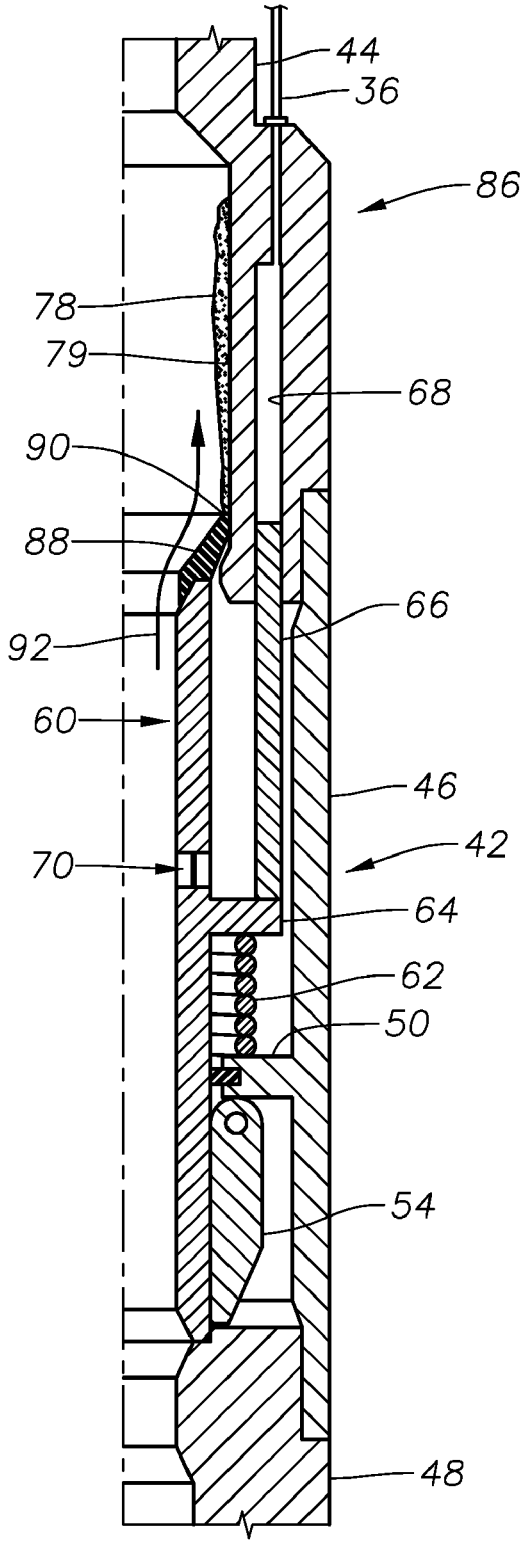
FIG. 6 is a side, one-quarter cross-sectional view of a further preferred embodiment for a SCSSV constructed in accordance with the present invention.

FIG. 6 illustrates an alternative exemplary embodiment for a SCSSV 86 in accordance with the present invention. The valve 86 includes a substantially soft wiper member 88 that extends axially upwardly from the flow tube 60. The wiper member 88 is angled radially outwardly at its upper end 90 and tapered. The outward angle and the taper permit streamlined flow of wellbore fluid, as indicated by the flow arrow 92. The wiper member 88 is preferably formed of a softer non-elastomeric material, such as a thermoplastic, but other suitable materials may also be used. In a preferred embodiment, the wiper member 88 contains a scale dissolver that is released upon surface 79 to remove and prevent scale buildup 78. In operation, during movement of the flow tube 60 allows the wiper member 88 to move and flex over scale 78. Scale dissolver is released to help remove the buildup 78 and prevent buildup from occurring.

Figure 7:
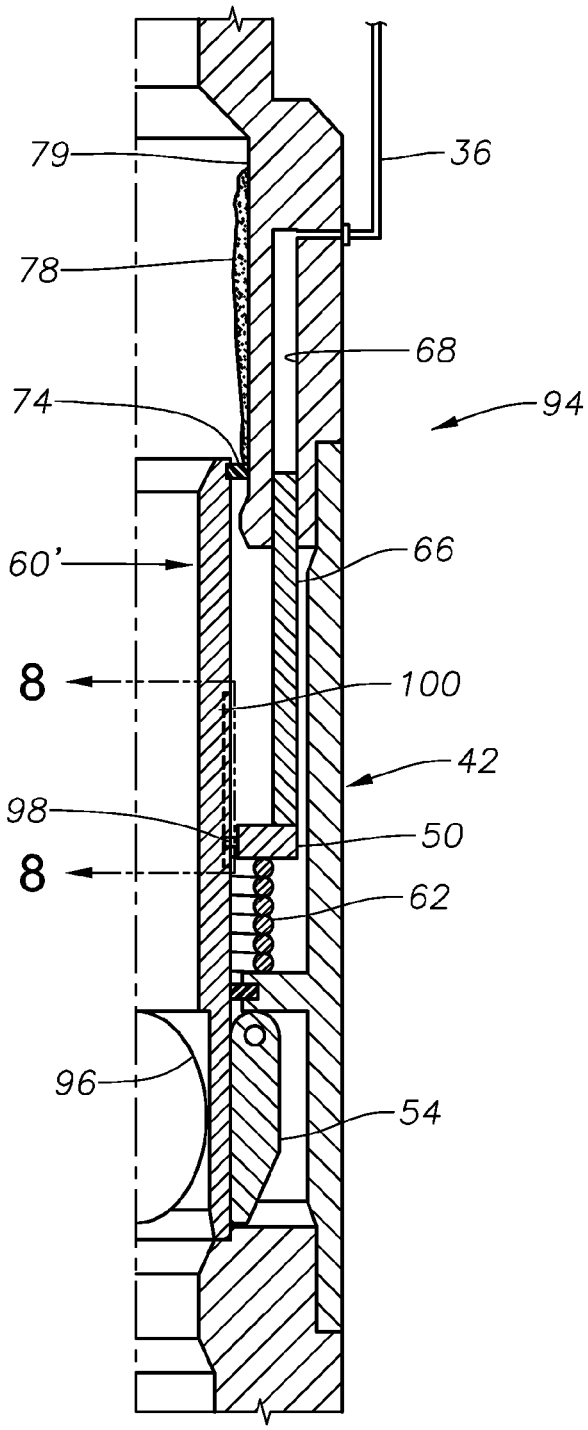
FIG. 7 is a side, one-quarter cross-sectional view of a further preferred embodiment for a SCSSV constructed in accordance with the present invention.
Figure 8:
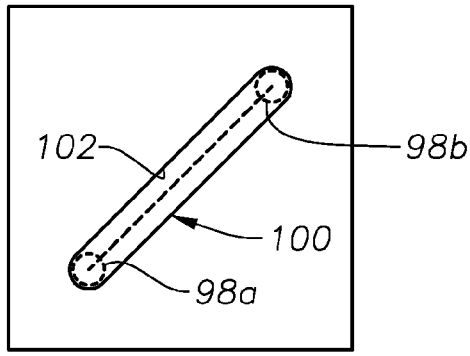
FIG. 8 is a detail drawing depicting an exemplary j-slot arrangement used with the SCSSV of FIG. 7.

FIGS. 7 and 8 illustrate a further exemplary embodiment for a SCSSV 94, in accordance with the present invention. The flow tube 60' of the SCSSV 94 includes an annular wiper member 74. In addition, a flapper member opening 96 is disposed through the body of the flow tube 60' and is sufficiently large to permit the flapper member 54 to pass through without restriction. A lug pin 98 projects radially inwardly from the flange 50. The flow tube 60' has a "J-slot" lug path 100 inscribed on its outer radial surface. FIG. 8 illustrates an exemplary lug path 100. As FIG. 8 shows, the lug path 100 is made up of a single inscribed leg 102 which is disposed at an angle with respect to the axial axis of the flow tube 60'. The lug pin 98 extends into the lug path 100. It is noted that the flow tube 60' is movable rotationally with respect to the surrounding housing 42 but need not be movable axially with respect to the housing 42. Movement of the flow tube 60' is governed by the interface between the lug pin 98 and the lug path 100.

During run-in and typical operation, the SCSSV 94 is in the position depicted in FIG. 7 with the flapper member 54 retained in the open position by the flow tube 60'. The lug pin 98 is located generally in the position indicated at 98*a* in FIG. 8. In order to close the SCSSV 94, the piston chamber 68 is evacuated by the pump 38, and the piston member 66 moves axially upwardly within the piston chamber 68. As the flow tube 60' is moved axially upwardly, the lug pin 98 is moved along the vertical leg 104 of the lug path 100 to the general position depicted at 98*c* in FIG. 8. Movement of the lug pin 98 along the lug path 100 will cause the flow tube 60' to rotate approximately 90 degrees with respect to the housing 42. Rotation of the flow tube 60' will align the flapper member opening 96 with the flapper member 54, thereby allowing the flapper member 54 to move to its closed position under impetus of its torsional spring (not shown).

During radial movement of the flow tube 60', the wiper member 74 will physically wipe away some of the scale buildup 78.

Figure 9:
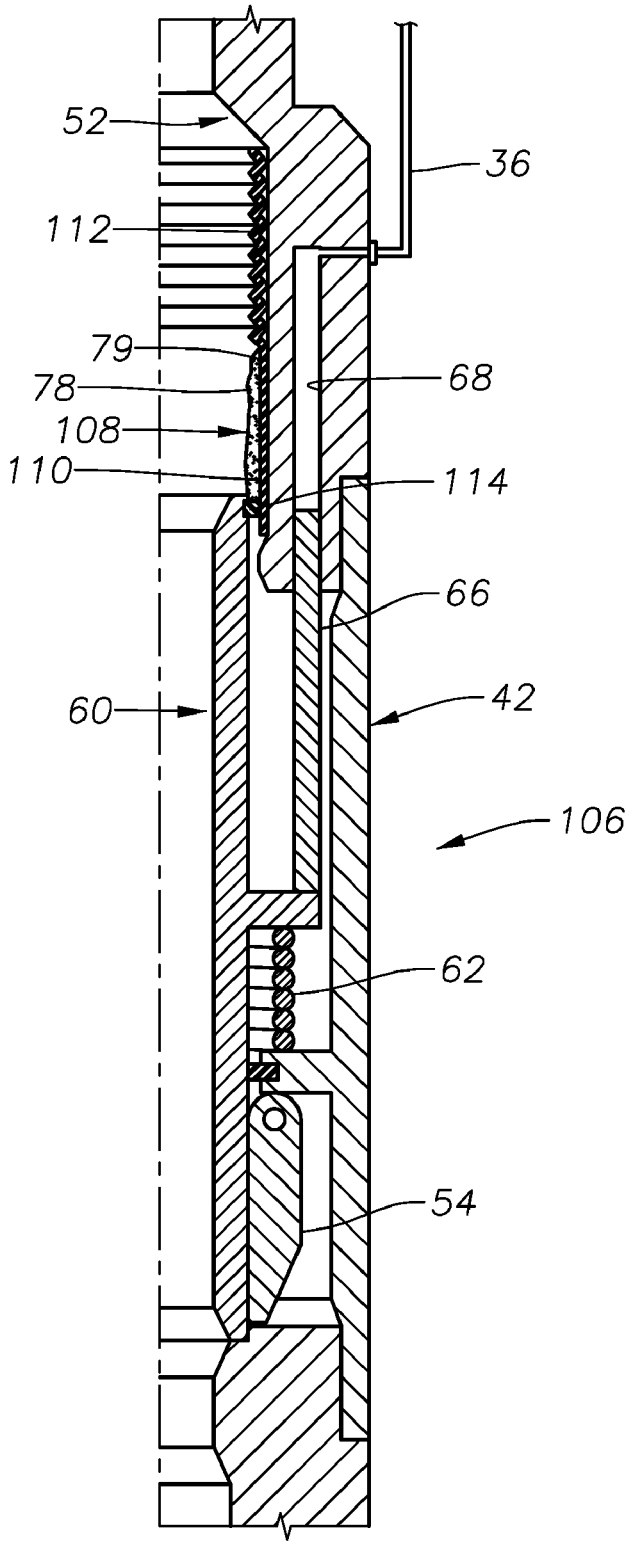
FIG. 9 is a side, one-quarter cross-sectional view of a further preferred embodiment for a SCSSV constructed in accordance with the present invention.
Figure 10:
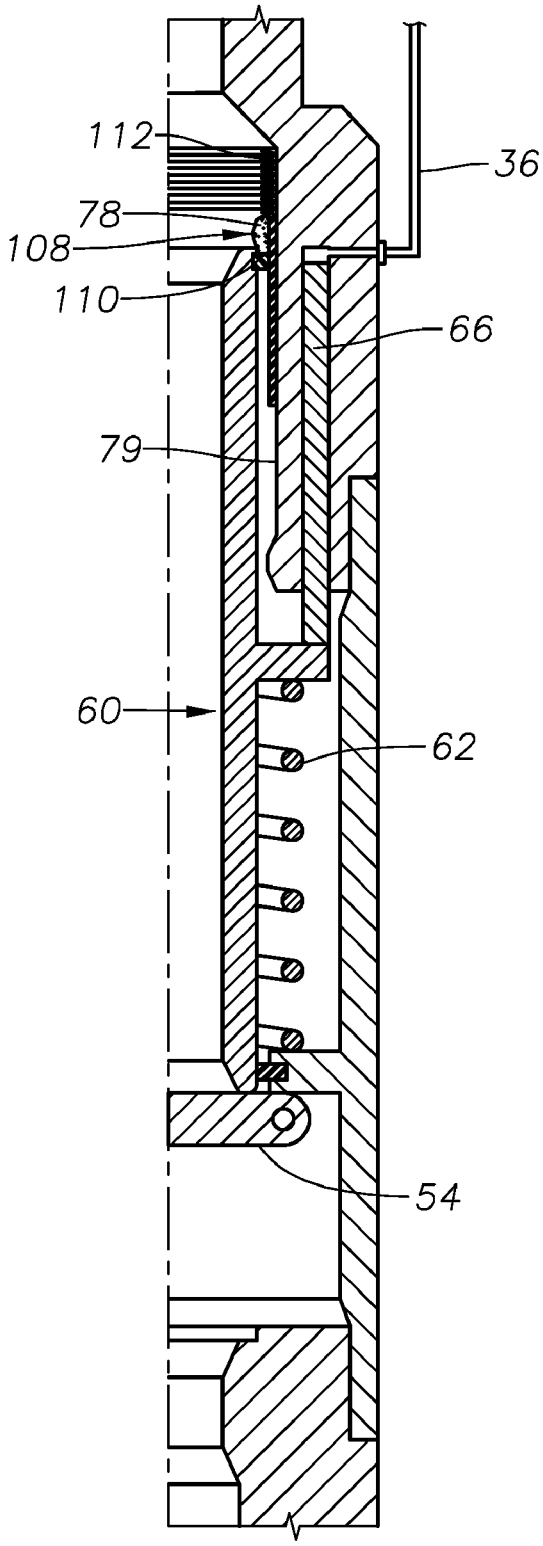
FIG. 10 is a side, one-quarter cross-sectional view of the SCSSV shown in FIG. 9, now in a closed position.

FIGS. 9 and 10 depict a further alternative SCSSV 106 wherein the interior surface 79 of the flowbore 52 is covered by a sleeve 108. Preferably, the sleeve 108 is formed of a flexible material, such as elastomer. The sleeve 108 includes a sheath portion 110 that conforms closely to the interior surface 79. Scale buildup 78 accumulates on the sleeve 108 rather than the interior surface 79. The sleeve 108 also includes an axially compressible portion 112. In a currently preferred embodiment, the compressible portion 112 is made up of a series of folds which may be compressed in the manner of an accordion bellows. A contact arm 114 preferably extends radially outwardly from the flow tube 60 and into engagement with the sheath portion 110 of the sleeve 108. In operation, when the flow tube 60 is moved axially upwardly within the housing 42, the sleeve 108 is urged axially upwardly upon the interior surface 79 by the contact arm 114. The compressible portion 112 of the sleeve 108 is compressed, as depicted in FIG. 10, and the sheath portion 110 slides upwardly upon the surface 79 to expose a clean surface 79 which is substantially free of scale buildup 78.

Figure 11:
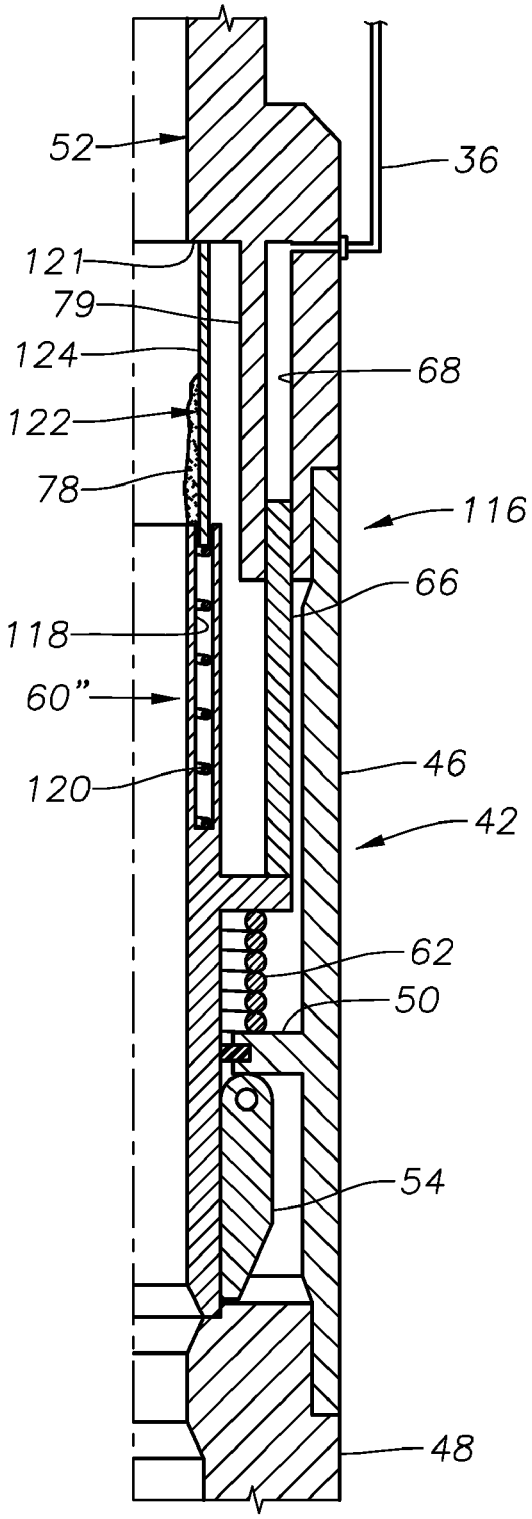
FIG. 11 is a side, one-quarter cross-sectional view of a further alternative embodiment for an SCSSV constructed in accordance with the present invention.
Figure 12:
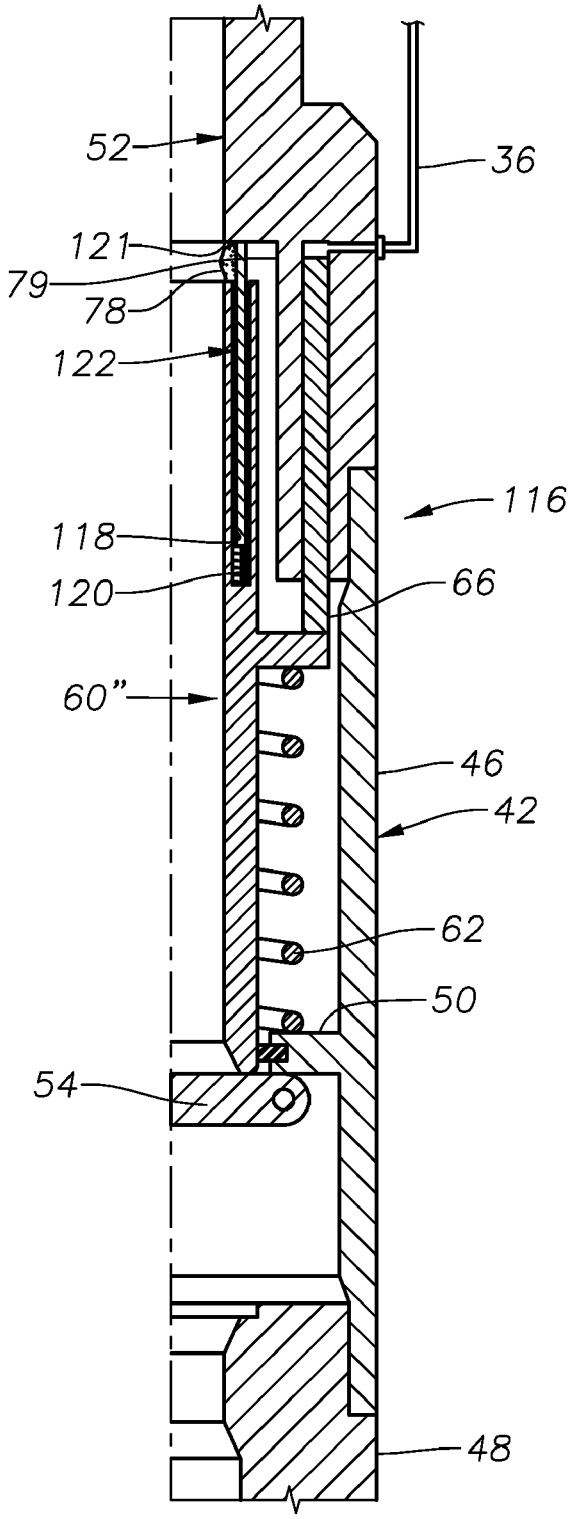
FIG. 12 is a side, one-quarter cross-sectional view of the SCSSV shown in FIG. 11, now in a closed position.

FIGS. 11 and 12 depict a further alternative SCSSV 116. The SCSSV 116 includes a modified flow tube 60" which includes an annular recess 118 at its upper end. The recess 118 contains an axially compressible spring 120. A substantially rigid sleeve 122 is also disposed within the recess 118 and is biased axially upwardly by the spring 120 until it is in contact with a radially-inwardly projecting ledge 121. FIG. 11 depicts the SCSSV 116 in an initial position with the SCSSV 116 is open and flow therethrough is occurring naturally. The sleeve 122 substantially prevents fluid flowing through the flowbore 52 from contacting and depositing scale upon the interior surface 79. Additionally, the sleeve 122 presents an interior radial surface 124. Scale buildup 78 would occur on the interior surface 124 of the sleeve 122.

When the SCSSV 116 is moved to its closed position, as depicted in FIG. 12, the spring 120 is compressed and the sleeve 122 is moved downwardly into the recess 118. The spring 120 continues to urge the sleeve 122 against the ledge 121. As the sleeve 122 sleeve 122 is moved into the recess 118, the scale buildup 78 is scraped from the interior surface 124. It is preferred that relatively close tolerances be used to aid the effectiveness of the scraping removal of the scale buildup 78. Additionally, the sleeve 122 minimizes changes in the interior diameter of the flowbore 52 of the valve housing 42, which helps to prevent scale buildup from occurring within the flowbore 52.

Figure 13:
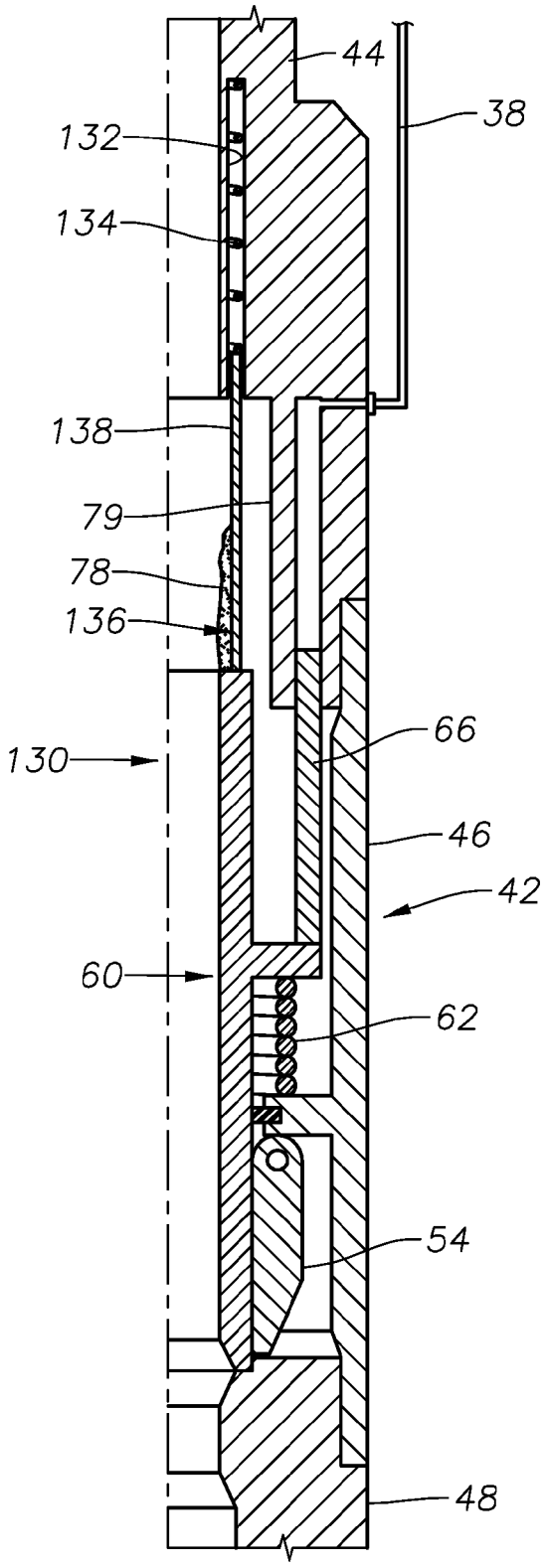
FIG. 13 is a side, one-quarter cross-sectional view of a further alternative embodiment for an SCSSV constructed in accordance with the present invention.
Figure 14:
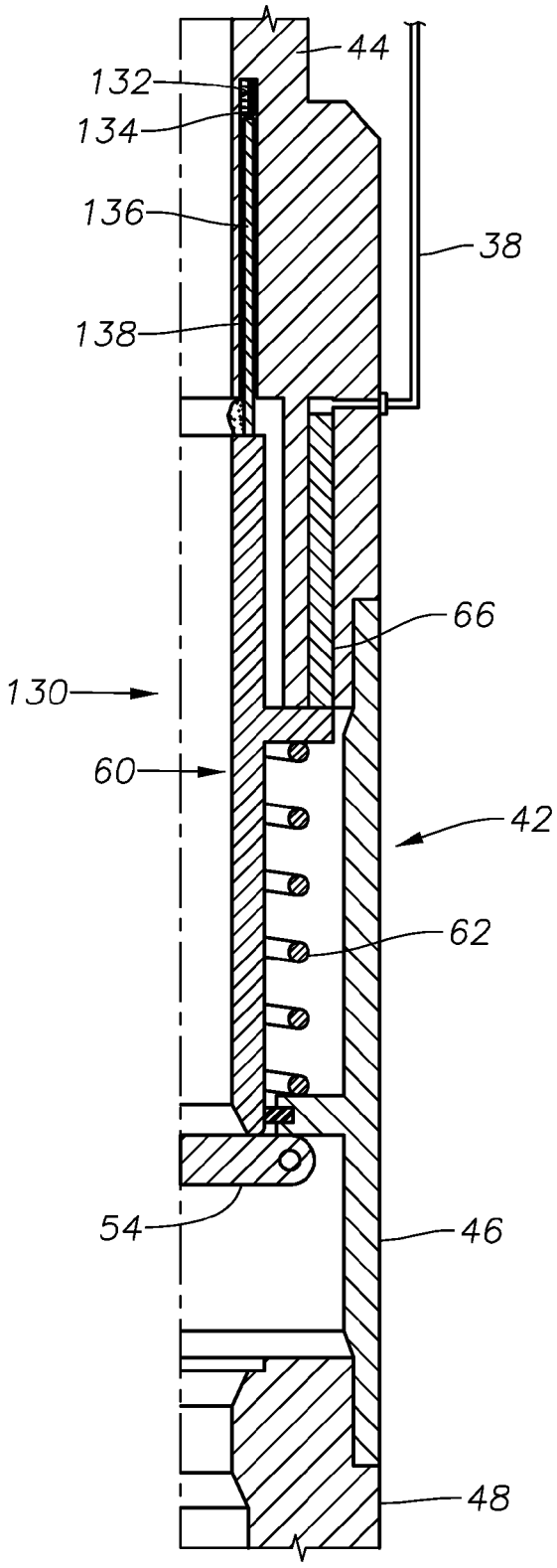
FIG. 14 is a side, one-quarter cross-sectional view of the SCSSV shown in FIG. 13, now in a closed position.

FIGS. 13 and 14 depict a further alternative embodiment for an SCSSV 130 constructed in accordance with the present invention. The upper housing sub 44 of the housing 42 includes an annular axial recess 132 which retains an axially compressible spring 134 and a substantially rigid annular sleeve 136. The spring 134 biases the sleeve 136 axially downwardly and into contact with the upper end of the flow tube 60. FIG. 13 depicts the SCSSV 116 in an initial position with the SCSSV 130 is open and flow therethrough is occurring. The sleeve 136 substantially prevents fluid flowing through the flowbore 52 from contacting and depositing scale upon the interior surface 79. Additionally, the sleeve 136 presents an interior radial surface 138. Scale buildup 78 would occur on the interior surface 138 of the sleeve 136.

When the SCSSV 130 is moved to its closed position, as depicted in FIG. 14, the spring 134 is axially compressed as the sleeve 136 retracts into the recess 132. The spring 134 continues to urge the sleeve 132 against the flow tube 60. As the sleeve 132 is moved into the recess 132, the scale buildup 78 is scraped from the sleeve 132. It is preferred that relatively close tolerances be used to aid the effectiveness of the scraping removal of the scale buildup 78. Additionally, the sleeve 132 minimizes changes in the interior diameter of the flowbore 52 of the valve housing 42, which helps to prevent scale buildup from occurring within the flowbore 52.

Figure 15:
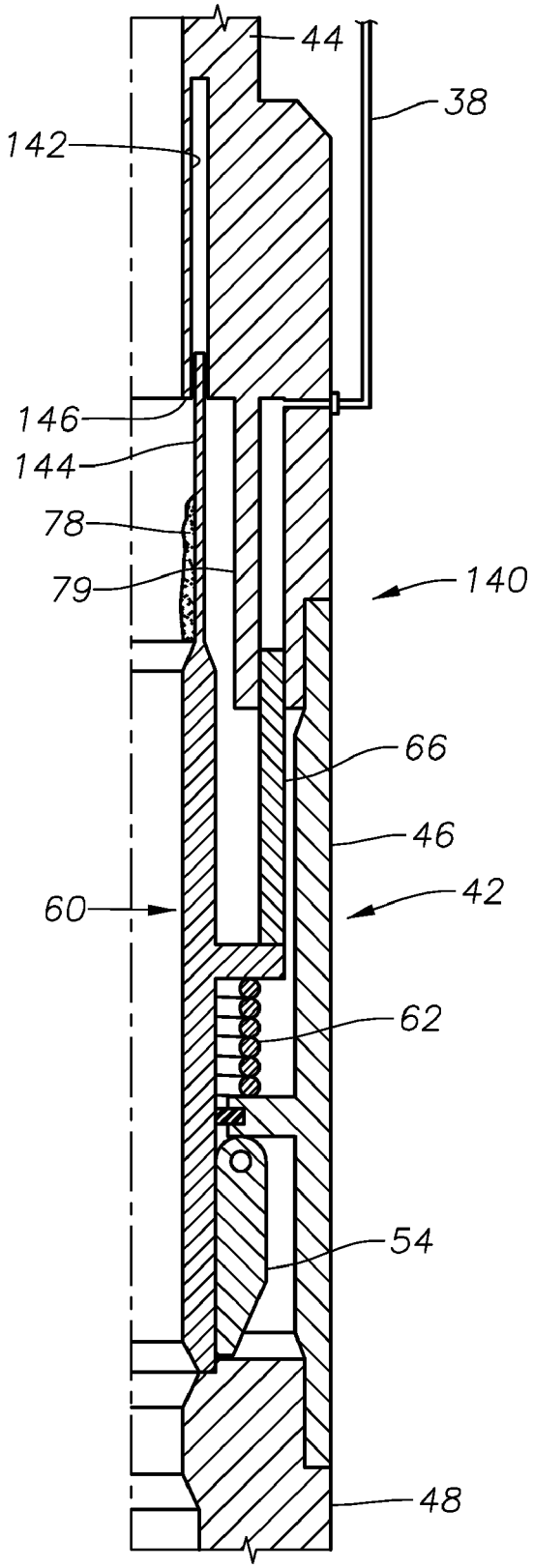
FIG. 15 is a side, one-quarter cross-sectional view of a further alternative embodiment for an SCSSV constructed in accordance with the present invention.
Figure 16:
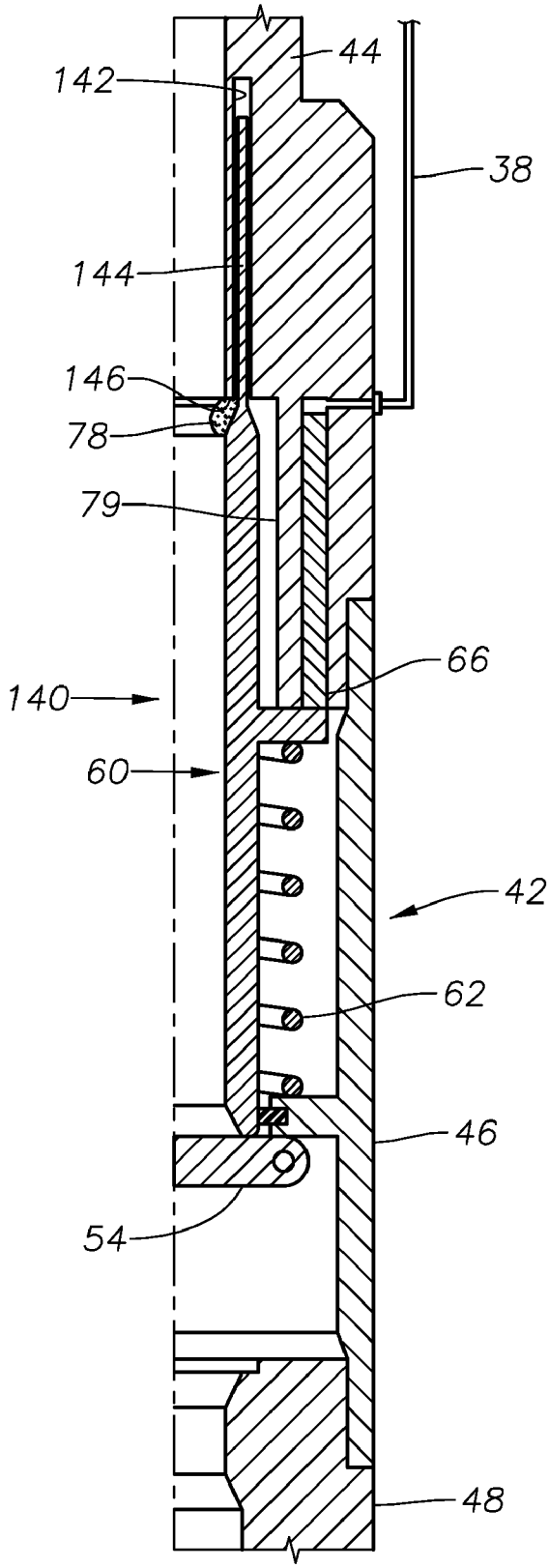
FIG. 16 is a side, one-quarter cross-sectional view of the SCSSV shown in FIG. 15, now in a closed position.

FIGS. 15 and 16 illustrate a further alternative embodiment for an SCSSV 140 constructed in accordance with the present invention. The upper housing sub 44 defines an annular recess 142. The flow tube 60 includes an axially extending annular shield portion 144 which extends into the recess 142. The shield portion 144 prevents scale buildup 78 from occurring on the interior surface 79. Instead, scale buildup 78 will form on the shield portion 144. As the SCSSV 140 is moved to the closed position, as depicted in FIG. 16, a lower shoulder 146 on the upper sub 44 will scrape the scale buildup 78 from the shield portion 144. Additionally, the shield portion 144 minimizes changes in the interior diameter of the flowbore 52 of the valve housing 42, which helps to prevent scale buildup from occurring within the flowbore 52.

Figure 17:
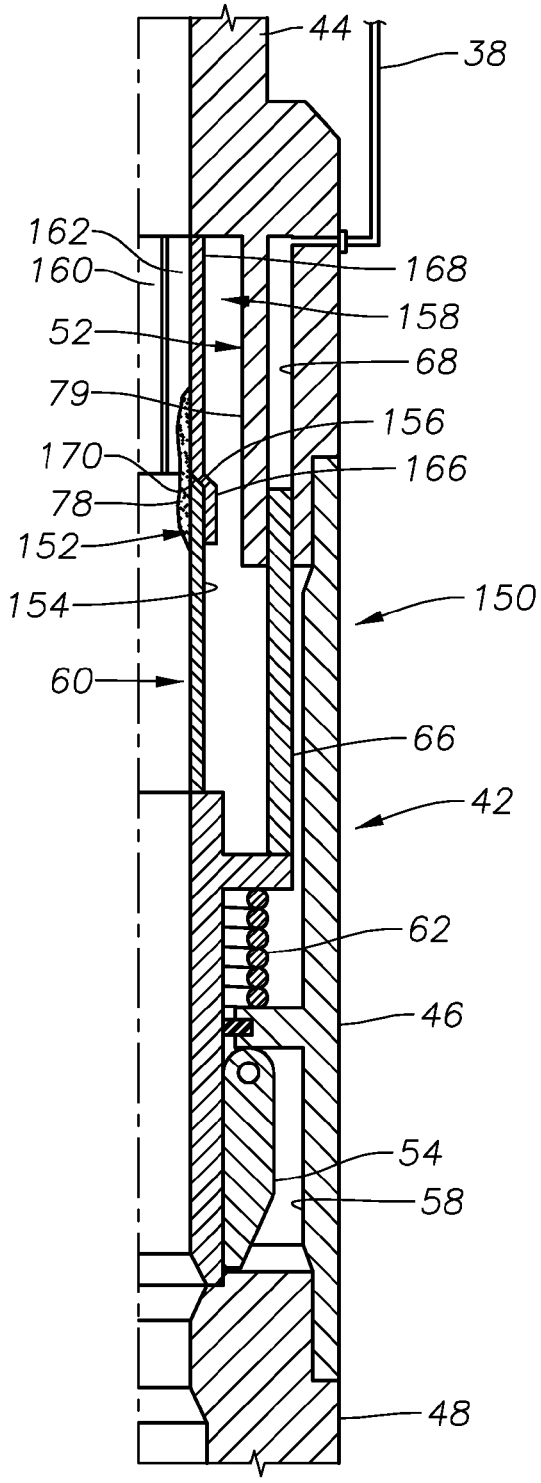
FIG. 17 is a side, one-quarter cross-sectional view of another alternative embodiment for an SCSSV constructed in accordance with the present invention.
Figure 18:
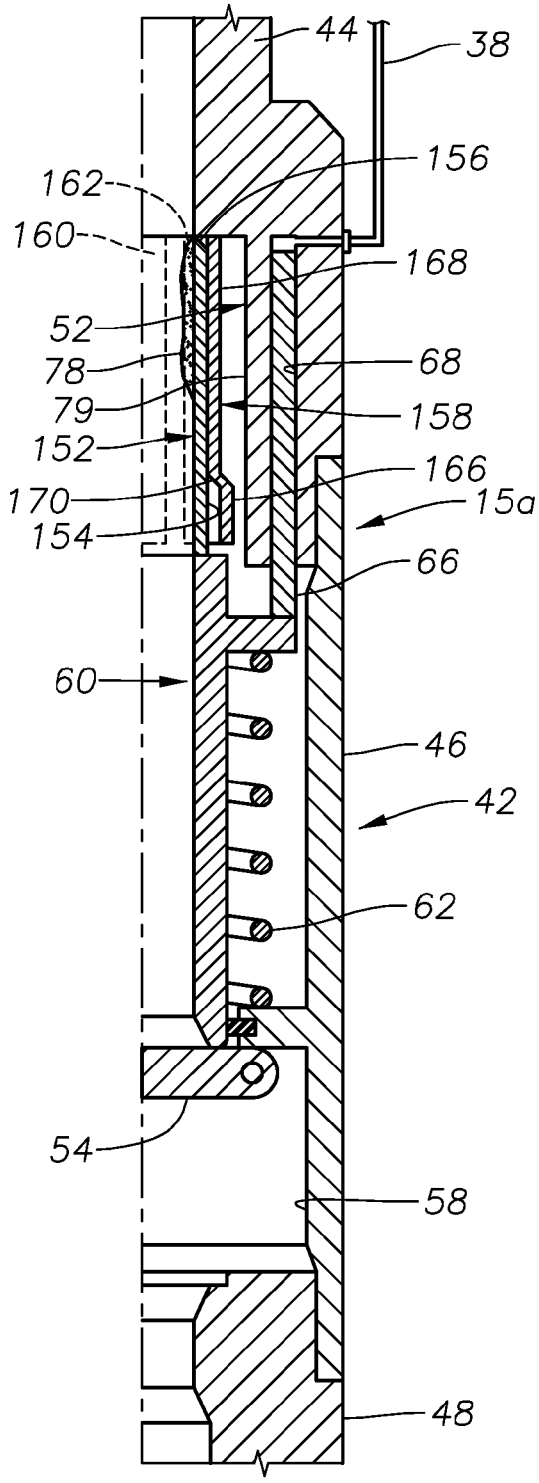
FIG. 18 is a side, one-quarter cross-sectional view of the SCSSV shown in FIG. 17, now in a closed position.
Figure 19:
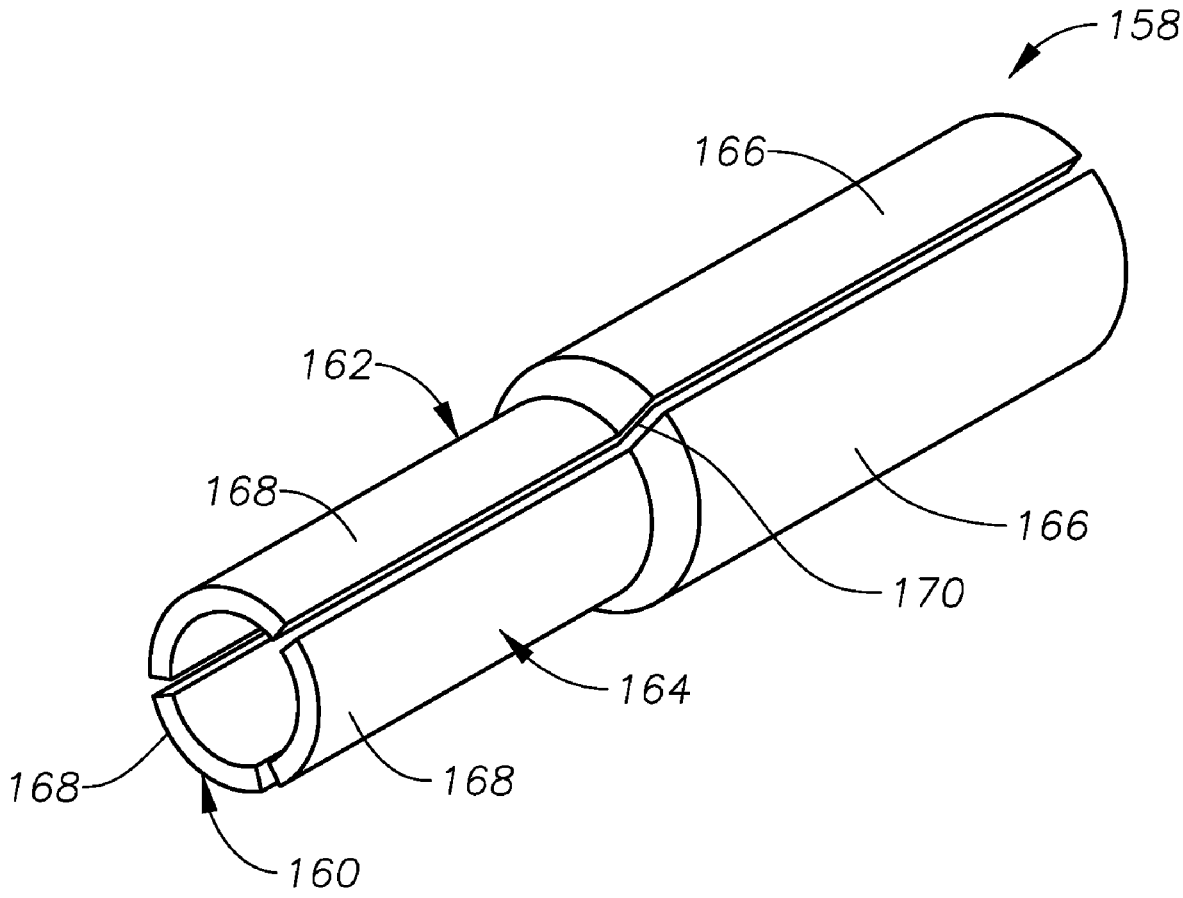
FIG. 19 is an isometric view of a component of the SCSSV shown in FIGS. 17-18, shown apart from the other components of the SCSSV.

FIGS. 17, 18 and 19 illustrate another alternative embodiment for an SCSSV 150 constructed in accordance with the present invention. The flow tube 60 of the SCSSV 150 presents an upwardly axially-extending shield portion 152. The axially-extending shield portion 152 has a reduced outer radial diameter surface 154. The upper axial end of the shield portion 152 is preferably provided with an outwardly and upwardly facing angled edge 156.

A split sleeve element 158 is located within the flowbore 52 above the shield portion 152. FIG. 19 shows the split sleeve element 158 apart from the other components of the SCSSV 150. In the depicted embodiment, the split sleeve element 158 includes multiple radially separated arcuate sections 160, 162, 164. Although there are four sections 160, 162, 164 depicted in FIGS. 17, 18 and 19, there may be more or fewer than 3, in desired. In a preferred embodiment, each of the sections 160, 162, 164 include a lower, radially-enlarged diameter portion 166 and an upper, radially-reduced diameter portion 168. An inwardly and downwardly-facing angled interior surface 170 is defined between the upper and lower portions 166, 168 of each section 160, 162, 164. The split sleeve element 158 is disposed axially above the shield portion 152 and the flow tube 60 within the flowbore 52. The angled interior surface 170 of each segment 160, 162, 164 is located in adjacent, abutting contact with the angled edge 156 of the shield portion 152. As a result, each of the arcuate sections 160, 162, 164 are located in a close, generally abutting relation to each other. While the SCSSV 150 is in the open position, as shown in FIG. 17, the shield portion 152 and the split sleeve element 158 protect the interior surface 79 against a buildup of scale.

When the SCSSV 150 is moved to the closed position, as depicted in FIG. 18, the flow tube 60 and affixed shield portion 152 are moved axially upwardly within the flowbore 52. The angled edge 156 of the shield portion 152 slides against the angled interior surface 170 of each of the arcuate sections 160, 162, 164 of the split sleeve element 158, thereby causing the arcuate sections 160, 162, 194 to separate from one another radially (see FIG. 18). The shield portion 152 slides inside of the upper portions 168 of the segments 160, 162, 164, as depicted in FIG. 18.

Scale buildup 78 on the shield portion 152 or the split sleeve element 158 will be broken up and removed as the shield portion 152 slides axially upwardly and within the upper portions 168 of the segments 160, 162, 164. As the segments 160, 162, 164 separate from one another radially, scale buildup 78 will be broken up and carried away by the flow of production fluids within the flowbore 52. Also, scale buildup 78 on the interior of the upper portions 168 will be scraped away by the shield portion 152.

Figure 20:
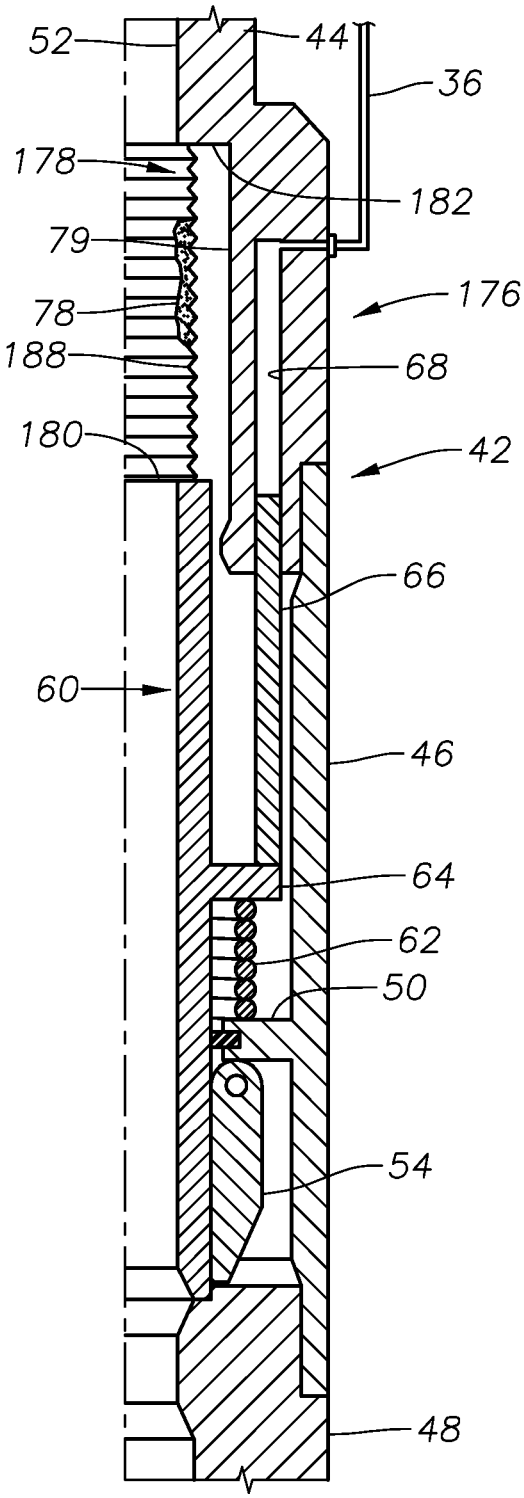
FIG. 20 is a side, one-quarter cross-sectional view of a further alternative embodiment for an SCSSV constructed in accordance with the present invention.
Figure 21:
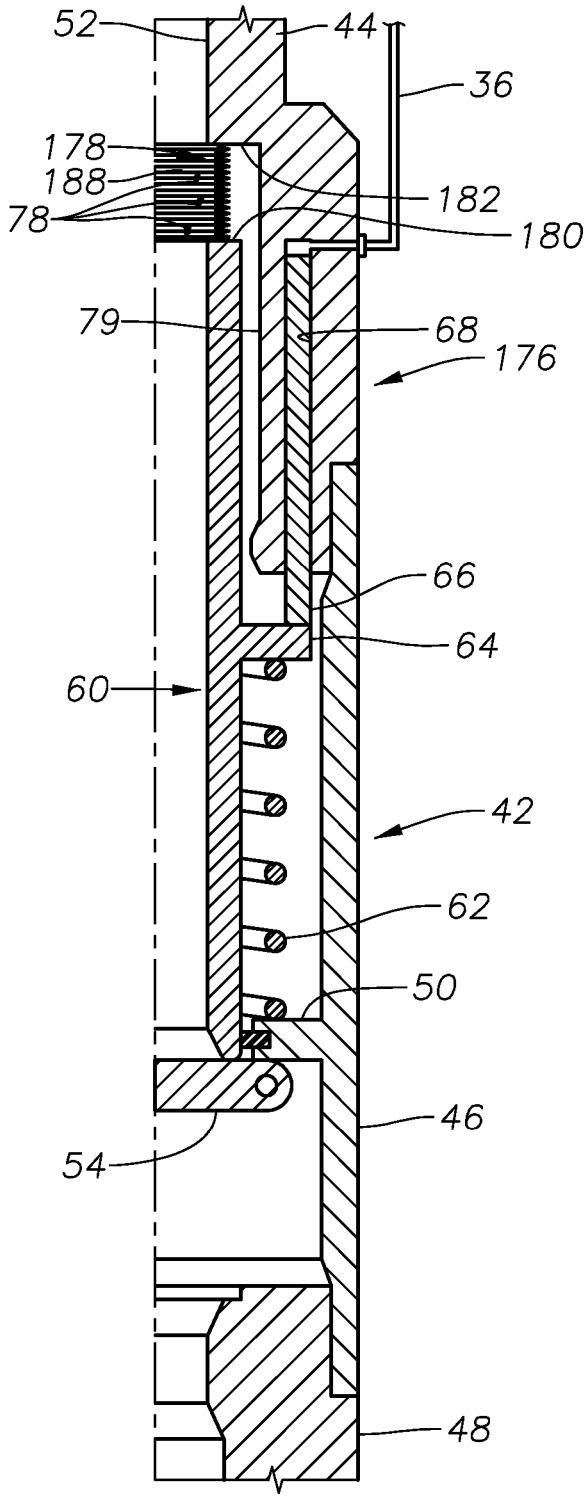
FIG. 21 is a side, one-quarter cross-sectional view of the SCSSV shown in FIG. 20, now in a closed position.

FIGS. 20 and 21 depict still a further alternative embodiment for another SCSSV 176 constructed in accordance with the present invention. The SCSSV 176 includes an axially collapsible sleeve 178 which extends from, and is preferably affixed to, the upper end 180 of the flow tube 60. The sleeve 178 is preferably also affixed at its upper end to a ledge portion 182 of the housing 42 so that the sleeve 178 functions as a shield for the interior surface 79 of the housing 42. The presence of sleeve 178 also minimizes changes in the interior diameter of the flowbore 52 through the valve 176, thereby reducing the possibility that scale will accumulate at points within the flowbore 52. The sleeve 178 is preferably formed of a section of sheet metal. In a currently preferred embodiment, the sleeve 178 is a corrugated sheet 188 that is axially expandable and compressible in the manner of an accordion bellows. The presence of the sleeve 178 minimizes changes in the diameter of the flowbore 52 of the SCSSV 176, thereby reducing pressure changes within the flowbore that might promote the deposition of scale within the flowbore 52.

When the SCSSV 176 is actuated to a closed position, as illustrated in FIG. 21, the flow tube 60 moves axially upwardly to cause the sleeve 178 to be axially compressed. As depicted, the sleeve 178 preferably collapses in the manner of an accordion bellows. As this axial compression occurs, the scale buildup 78 will be broken up and thereafter carried away by the flow of production fluid through the flowbore 52.

It will be appreciated that the invention provides devices and methods for negating buildup of scale and other debris within the flowbore of a sliding sleeve valve. In some aspects, a wiper member is affixed to the flow tube and acts as a spacer between the flow tube and the surrounding valve housing. The increased clearance between the flow tube 60 and the surrounding valve housing 42 as a result of the spacer will permit the valve to operate longer without becoming inoperable due to the expanded clearance area becoming fouled with scale buildup. In addition, the wiper member is operable to physically wipe away scale buildup from the interior radial surface of the valve housing. In some embodiments, the wiper member incorporates a scale dissolver material that can be disposed onto the interior radial surface to assist the breakup and removal of scale buildup. In other aspects of the invention, scale buildup is negated by disposing a shield or sleeve within the flowbore to provide a substantially smooth flowbore without significant changes in diameter. This would eliminate points within the flowbore wherein there are pressure changes that could encourage the growth of scale buildup. In addition, the shield of sleeve would physically protect the interior radial surface from scale buildup. Production fluid flowed through the flowbore of the valve would cause buildup on the shield rather than on the interior radial surface.

The foregoing description is directed to particular embodiments of the present invention for the purpose of illustration and explanation. It will be apparent, however, to one skilled in the art, that many modifications and changes to the embodiment set forth above are possible without departing from the scope and the spirit of the invention.

What is claimed is:

1. A flapper valve comprising:

a valve housing defining a flowbore which presents an interior radial surface upon which it is desired to negate scale buildup;

a flapper member disposed within the flowbore and pivotably moveable with respect to the valve housing between an open position, wherein fluid can flow through the flowbore, and a closed position, wherein the flapper member blocks fluid flow through the flowbore;

a flow tube axially moveably disposed within the flowbore between a first position, wherein the flow tube retains the flapper member in the open position, and a second position, wherein the flapper member can move to its closed position; and a device for negating buildup of scale upon the interior radial surface, the device comprising a wiper member for removing scale buildup from the interior radial surface.

2. The flapper valve of claim 1 wherein the interior radial surface comprises a surface that is located within the flowbore axially above an axial end of the flow tube.

3. The flapper valve of claim 1 wherein the wiper member is at least partially formed of a scale dissolver substance.

4. The flapper valve of claim 1 wherein the wiper member is substantially formed of an elastomeric material.

5. The flapper valve of claim 1 wherein the wiper member is substantially formed of a thermoplastic material.

6. The flapper valve of claim 1 wherein the wiper member is affixed to the flow tube and extends radially outwardly from the flow tube and into contact with the interior radial surface.

7. A flapper valve comprising:

a valve housing defining a flowbore;

a flapper member disposed within the flowbore and pivotably moveable with respect to the valve housing between an open position, wherein fluid can flow through the flowbore, and a closed position, wherein the flapper member blocks fluid flow through the flowbore;

a flow tube disposed within the flowbore, the flow tube having a body with a flapper member opening disposed therethrough, the flapper member opening being shaped and sized to permit the flapper member to move through the flapper member opening between its open and closed positions; and the flow tube being moveable between a first rotational position, wherein the flow tube retains the flapper member in the open position, and a second position, wherein the flapper member can move to its closed position through the flapper member opening.

8. A method of negating scale buildup on an interior radial surface of a flapper valve flowbore of a flapper valve having a flapper valve housing and a flow tube that is axially moveable with respect to the flapper valve housing, the method comprising the steps of:

securing a wiper member to a flow tube within the flapper valve;

the wiper member forming an expanded clearance between the flow tube and the flapper valve housing to prevent scale buildup upon the interior radial surface from precluding movement of the flow tube with respect to the flapper valve housing; and disposing scale dissolver upon the interior radial surface.

9. A method of negating scale buildup on an interior surface of a flapper valve flowbore of a flapper valve comprising the steps of:

disposing a shield within the flowbore to protect the interior radial surface from scale buildup, the shield being at least partially disposed within a recess and retracting into the recess as a flow tube is moved axially with respect to a housing of the flapper valve; and flowing hydrocarbon production fluid through the flowbore.

10. A flapper valve comprising:

a valve housing defining a flowbore which presents an interior radial surface upon which it is desired to negate scale buildup;

a flapper member disposed within the flowbore and pivotably moveable with respect to the valve housing between an open position, wherein fluid can flow through the flowbore, and a closed position, wherein the flapper member blocks fluid flow through the flowbore;

a flow tube axially moveably disposed within the flowbore between a first position, wherein the flow tube retains the flapper member in the open position, and a second position, wherein the flapper member can move to its closed position; and a device for negating buildup of scale upon the interior radial surface comprising a shield that prevents scale buildup from occurring on the interior radial surface, the shield comprising a substantially rigid sleeve that extends axially from an axial end of the flow tube, wherein the sleeve is at least partially disposed within a recess and retracts into the recess as the flow tube is moved axially with respect to the valve housing.

11. The flapper valve of claim 10 wherein the sleeve is biased axially outwardly from the recess by a compressive spring.

12. The flapper valve of claim 10 wherein the recess is formed in the valve housing.

13. The flapper valve of claim 10 wherein the recess is formed in the flow tube.

14. The flapper valve of claim 10 wherein the sleeve is affixed to an axial end of the flow tube.

15. The flapper valve of claim 14 further comprising a substantially annular split sleeve element covering at least a portion of the interior radial surface, the split sleeve element being made up of a plurality of radially separated arcuate segments, the radial separation of the segments being varied as the flow tube moves axially with respect to the valve housing.

16. The flapper valve of claim 10 wherein the shield comprises a sleeve that is secured to the flow tube and to the valve housing, the sleeve being axially collapsible as the flow tube is moved axially with respect to the valve housing.

* * * * *